US005803426A

United States Patent [19]

Hart

[11] Patent Number: 5,803,426

[45] Date of Patent: Sep. 8, 1998

[54] LOCKING FOOTING SOCKET TO IMPROVE POST IMPLANTATION

[76] Inventor: James Fowler Hart, Lot 8, Gemvale, Mudgeeraba, Queensland 4213, Australia

[21] Appl. No.: 506,076

[22] Filed: Jul. 24, 1995

[30] Foreign Application Priority Data

Jul. 25, 1994 [AU] Australia ..... PM7027
Sep. 28, 1994 [AU] Australia ..... 74259/94

[51] Int. Cl.[6] ..... F16M 13/00

[52] U.S. Cl. ..... 248/523; 248/530; 248/403; 52/298; 403/374 G

[58] Field of Search ..... 248/523 G, 530, 248/412, 544, 545; 52/298 G, 165, 704; 403/374 G, 409.1 G, 367 G, 11, DIG. 3

[56] References Cited

U.S. PATENT DOCUMENTS 3,441,239 4/1969 Frost ..... 248/545
4,021,977 5/1977 Deike ..... 52/98
4,553,358 11/1985 Deike ..... 52/298 X
4,979,724 12/1990 Williams ..... 403/374 X

FOREIGN PATENT DOCUMENTS 2555084 3/1988 Australia .
4144889 3/1990 Australia .
1493492 12/1993 Australia .
95150686 of 0000 United Kingdom .

*Primary Examiner*—Leslie A. Braun
*Assistant Examiner*—Kimberly T. Wood
*Attorney, Agent, or Firm*—Ladas & Parry

[57] ABSTRACT

A post support socket, in which an end portion of a post is supportable by a wedge member, and the post support socket has an elongate body in which a longitudinal bore extends from an inlet end of the body. The body includes a peripheral wall which has an internal surface defining the bore. A slot defined by the peripheral wall extends longitudinally from the inlet end of the body and opens to the bore along its length. The peripheral wall has a laterally offset portion which bridges the slot over part of the length of the slot from the inlet end of the body. In use of the post support socket, a post having an end portion received in the bore can be secured by forcefully driving a wedge member longitudinally into the slot from the inlet end, between the offset portion and the post end portion. The post then can be withdrawn from the support socket after forcefully driving the wedge member longitudinally in the same direction, beyond the offset portion, for discharge of the wedge member laterally outwardly away from the bore, such as through the slot, or into a chamber defined outside the body or into a section of the slot of larger cross-section.

11 Claims, 12 Drawing Sheets

FIG. 5
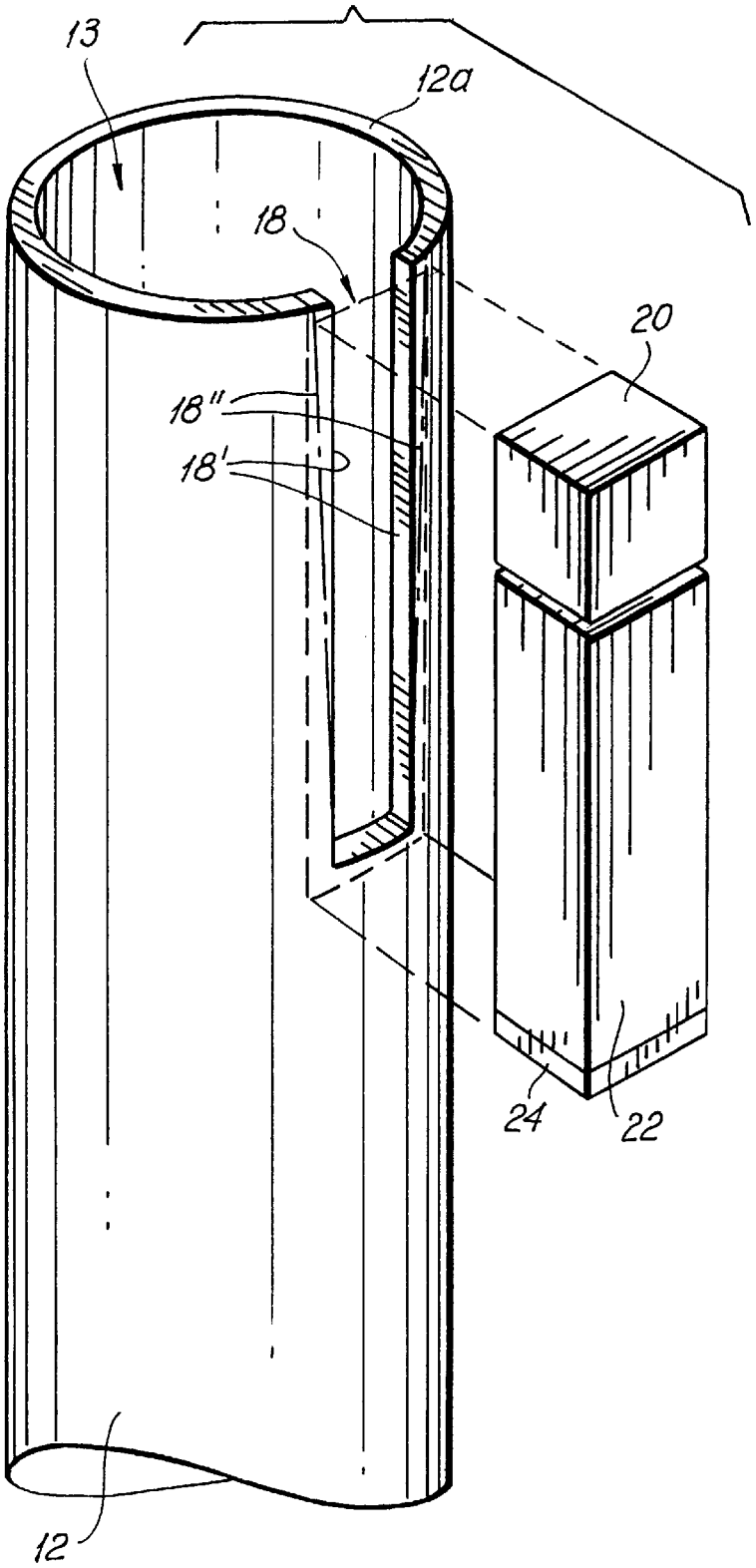
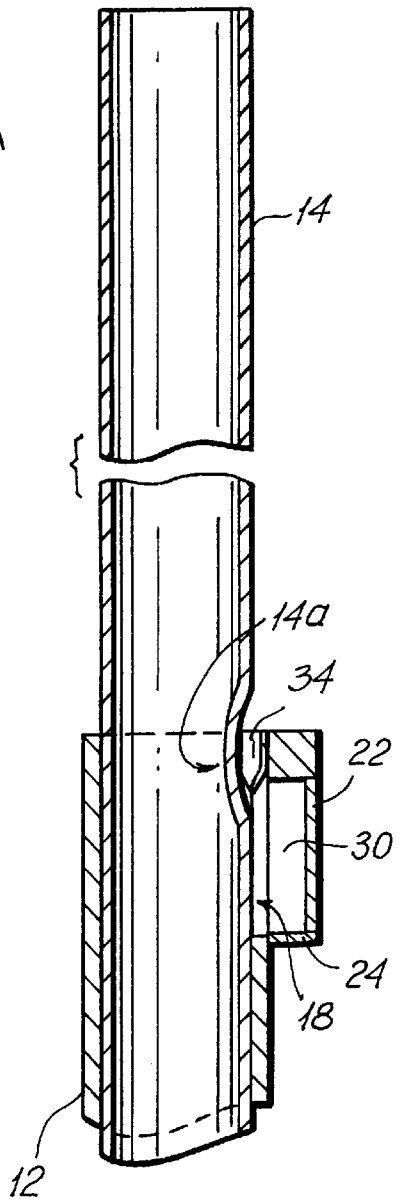
FIG. 6

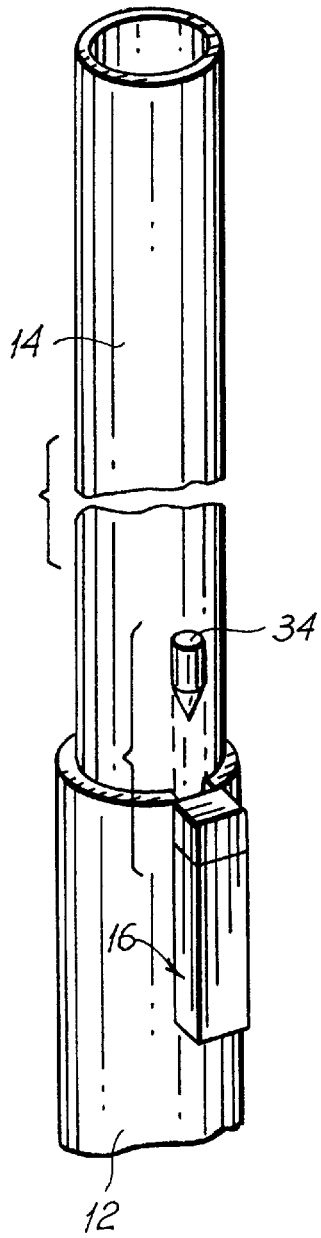
FIG. 7
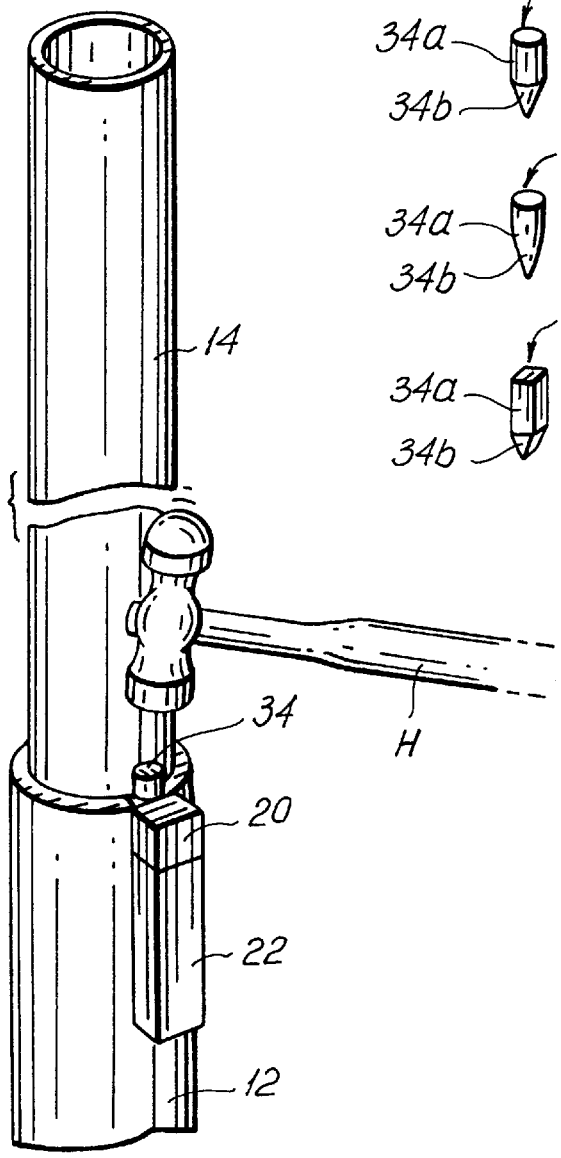
FIG. 8
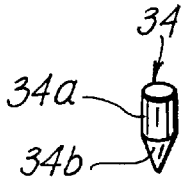
FIG. 9A
FIG. 9B
FIG. 9C

FIG. 25
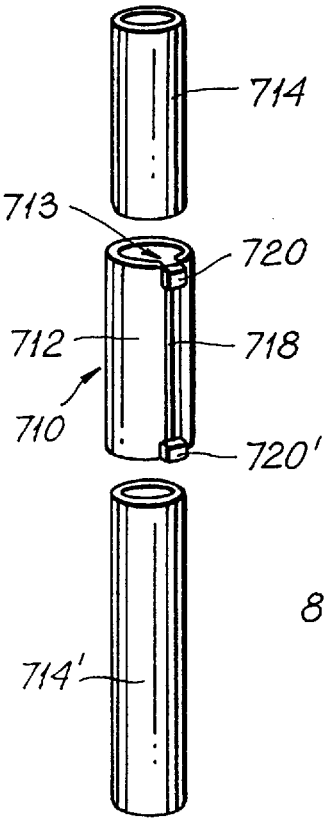
FIG. 26
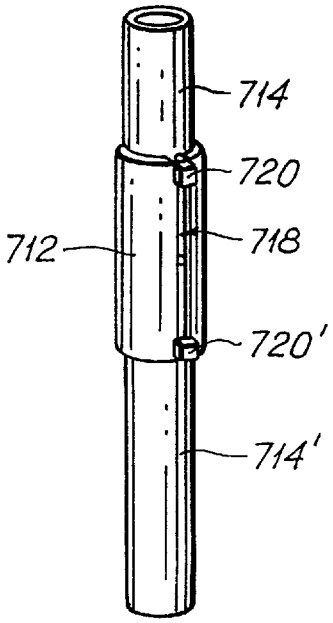
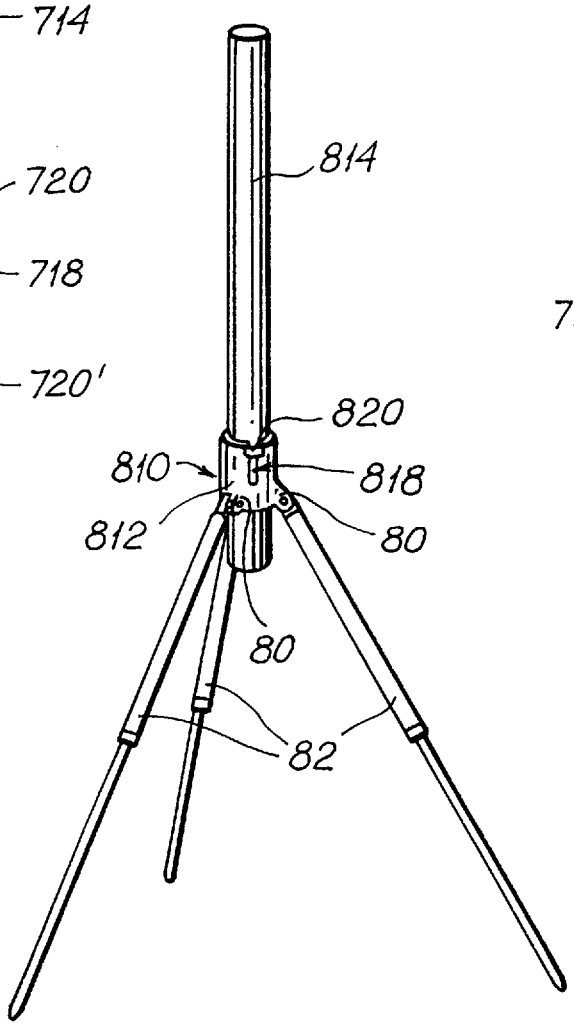
FIG. 27

LOCKING FOOTING SOCKET TO IMPROVE POST IMPLANTATION

BACKGROUND OF THE INVENTION

This invention relates to a locking footing socket for use in the implantation and/or support of vertical posts, such as sign posts and fence posts.

Many known installations of vertical posts have been accomplished by simply standing the post in the centre of a hole of suitable depth made in the ground and then filling the hole with concrete to encase the lower end of the post. This, in effect, renders the post fixed permanently and makes removal both difficult and expensive. However, sign support posts along roadways are often damaged by automobile accidents, necessitating their removal for maintenance or replacement. Also, fencing lines sometimes need relocating or replacement.

In a known alternative arrangement, an appropriately short piece of round steel pipe or box section, with a slightly larger inside dimension than a post is implanted into a concrete footing to act as a sleeve or socket into which the base of the post is received. In this sort of installation, a stub portion of the sleeve usually is left protruding above ground level to accommodate a horizontal cross bolt inserted through the exposed stub portion of the sleeve and the post. This arrangement allows easier subsequent removal of the post. However, it does not deter vandalism or theft very well as the bolt is easily seen as the obvious "lock" and simply removed. Also, when the post is purposely removed, the remaining protruding sleeve-stub is often a nuisance and/or a hazard.

In other instances, an oversized sleeve is used as a socket, and steel wedges are driven hard in between the walls of the socket and the post. The wedges are to prevent removal of the post by vandals, as removal of the wedges, when driven in properly, is extremely difficult. However, the wedges then also make difficult the intended removal of the post.

Digging a hole in the ground for the implantation of a post or a post holding socket is not always the most desired method of installation, with or without concrete. In some cases driving a stake into the ground to which the post is attached is a more desirable approach, and the use of post holding sockets surmounting elongated ground engaging spears is disclosed in Australian Patent Specification AU-B-25550/84, AU-A-41448/89 and AU-B-14934/92, which principally pertain to the use of wooden posts.

In the case of AU-B-25550/84, the wooden post is altered in size and shape to closely fit into the socket. Also, cross bolts can be required, necessitating the holding socket being above the ground surface.

In AU-B-14934/92, a pointed sheet metal wedge pierces the wood, which precludes its use with a metal post. The wedge barb-locks to the inner wall of the socket, such that removal is difficult. AU-A-41448/89 utilizes one or more sliding concave sheet metal pieces which are attached in a wedging fashion to wall portions of the holding socket, but are easily releasable and offer little protection against vandalism. None of the above-mentioned devices are intended to be or could successfully be used when buried in concrete.

A further proposal, by the present inventor, is disclosed in Australian Patent Specification AU-A-81532/91. In this, a tubular ground engaging socket is used as a footing for a post and a penannular wedge is forced into an annular clearance between a neck portion of the socket and the post. For removal of the post, the wedge can be driven down into an enlargement of the socket, below the collar. However, the arrangement is suitable only for socket and posts of circular cross-section, the wedge is difficult to drive into and out of wedging engagement and removal of the post can be impeded by the wedge continuing to grip the post after it is forced down into the enlargement of the socket.

SUMMARY OF THE INVENTION

It is an object of the present invention to provide a post support socket which can firmly lock a post and yet provide a non-obvious and simple method of unlocking the post for removal from the socket whether the installation be one buried flush to the ground surface as in concrete or compacted earth, or as a support socket integrated with and surmounting a spearhead or spike which is driven into the ground, or other form.

According to the present invention, there is provided a post support socket, in which an end portion of a post is supportable by a wedge member, wherein the socket has an elongate body in which a longitudinal bore extends from an inlet end of the body, such that the end portion of the post is insertable into the bore; the body includes a peripheral wall which defines the bore and which, over a part of the length of the body from the inlet end has a laterally offset portion which defines a longitudinal channel which opens to the bore, and wherein the peripheral wall defines a laterally open, longitudinal slot which provides a continuation of the channel beyond said offset portion whereby, with the end portion of the post received in the bore, the post is able to be secured in the socket by forcefully driving a wedge into the channel at the inlet end, between the offset portion and the post, and whereby the post can be released from securement in the socket by forcefully driving the wedge in the same direction, beyond the offset portion for discharge through the slot.

The invention also provides a post support socket, in which an end portion of a post is supportable, wherein the socket has an elongate body in which a longitudinal bore extends from an inlet end of the body, such that the end portion of the post is insertable into the bore; the body includes a peripheral wall which defines the bore and which, over at least part of the length of the body from the inlet end, has a laterally offset portion which defines a channel which opens to the bore; and wherein said channel, over part of its length from the inlet end, has a smaller cross-section than a longitudinally contiguous part of the length of the channel; whereby, with the end portion of the post received in the bore, the post is able to be secured in the socket by forcefully driving a wedge into the channel at the inlet end, between the post and a part of the offset portion at which the channel has said smaller cross-section, and whereby the post can be released from securement in the socket by forcefully driving the wedge in the same direction into a part of the offset portion into said contiguous part of the channel.

The sockets may be implanted into a hole in the ground and supported in a generally upright vertical position by filling the hole around the sleeve or socket with concrete, or other suitable footing material, with the top edge of the socket positioned flush to ground level. The post may be inserted into the socket and wedge locked in place and subsequently unlocked in a simple and rapid manner for the removal of the post without the requirement of special or abnormal tools and without the need for a portion of the sleeve to remain protruding above ground level. The unlocking procedure is not obvious to a casual observer.

In another form of the invention, the socket is secured to the top of a ground engaging portion such as a stake, spearhead or spike. This form of the invention negates the need to dig holes in the ground with the socket surmounting, parallel and integral with the spike. The spike is driven into the ground. The post is wedge locked into a socket and the combined unit stands secured in the ground, such as in a generally upright, vertical position. The ground engaging portion, the spike may be of any desired configuration but is preferably a cruciform section elongated taper.

In yet another form of the invention the post engaging socket is secured to a relatively heavy base plate so as to allow a post to stand vertical on a generally horizontal surface without implantation, and yet stand reasonably stable.

In another form the post engaging socket is fitted with three or more legs, as for example a tripod, also to support a post in a generally vertical position without the need for anchoring or implantation.

The socket, in each form of this invention, may be substantially circular, square, rectangular or other shapes in plan view so as to accommodate and suit the fitting and supporting or posts of differing sectional shape as well as posts of differing materials such as steel posts, plastic posts or wooden posts.

To assist with understanding the invention, reference will now be made to the accompanying drawings, in which:

BRIEF DESCRIPTION OF THE DRAWINGS

FIG. 5 is an exploded view showing the upper portion of the socket of FIG. 1, in the course of assembly;

FIG. 6 is an axial sectional view of FIG. 2, showing securement of the post in the socket of FIG. 1;

FIGS. 7 and 8 show stages in achieving the securement of the post as shown in FIG. 6;

FIGS. 9*a* to 9*c* show respective forms of securement wedge for use with the socket of FIG. 1;

FIGS. 25 and 26 show perspective views of a further embodiment of the invention as used in a different context; and FIGS. 27 to 29 show still further embodiments of the invention.

DETAILED DESCRIPTION OF THE INVENTION

Figure 1:
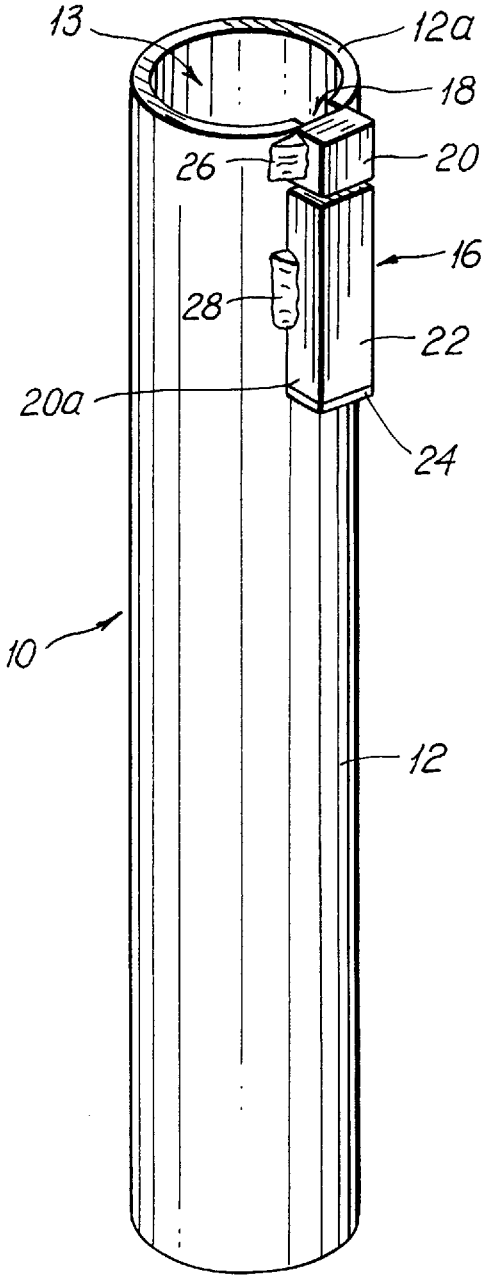
FIG. 1 is a perspective view of a socket according to a first embodiment of the invention.
Figure 2:
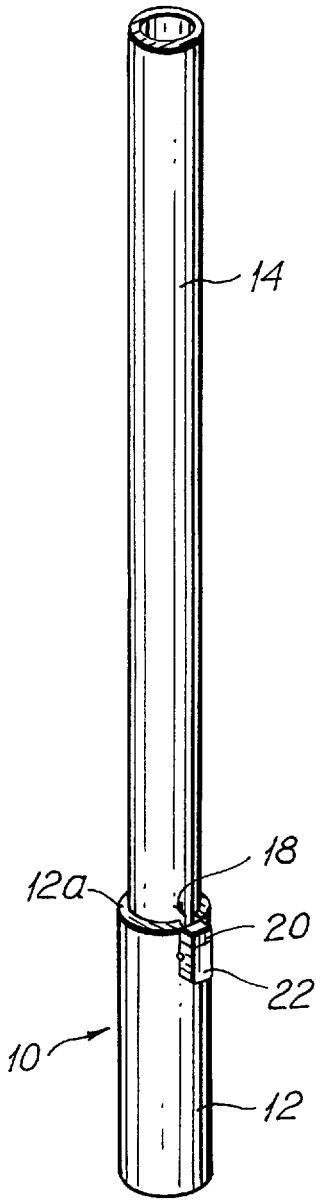
FIG. 2 shows the socket of FIG. 1, with a post mounted therein.

With reference to FIG. 1, there is shown a socket 10 according to the first embodiment of the invention. The socket 10 has an elongate tubular body 12, of steel or other suitable metal, which is of circular cross-section and defines a bore 13 for receiving the lower end of a post 14 to be supported in an upright position. At its upper end, body 12 is provided with a wedge retaining sub-assembly 16.

At sub-assembly 16, body 12 defines a slot 18 which extends longitudinally, a short distance from the upper end 12*a* of body 12. While slot 18 provides communication radially between bore 13 and the outer surface of body 12, slot 18 is bridged at the outer surface of body 12 by sub-assembly 16.

Sub-assembly 16 is comprised of three components, consisting of a wedge engaging member 20, an elongate C-section member 22, and a basal cover 24. The member 20 is a solid block of a metal suitable for welding to body 12. Member 20 is welded to the outer surface of body 12, adjacent to end 12*a* thereof, so as to bridge the upper end of slot 18; a weld being shown at 26. Immediately below member 20, each side flange 20*a* of member 22 is welded to the external surface of body 12, at a respective side of slot 18, as shown at 28. The cover 24 is welded to the external surface of body 12 and/or to the lower end of member 22 so as to close the lower end of member 22. Member 22 and cover 24 each are of a suitable metal for such welding, although welds retaining cover 24 are not shown.

Figure 3:
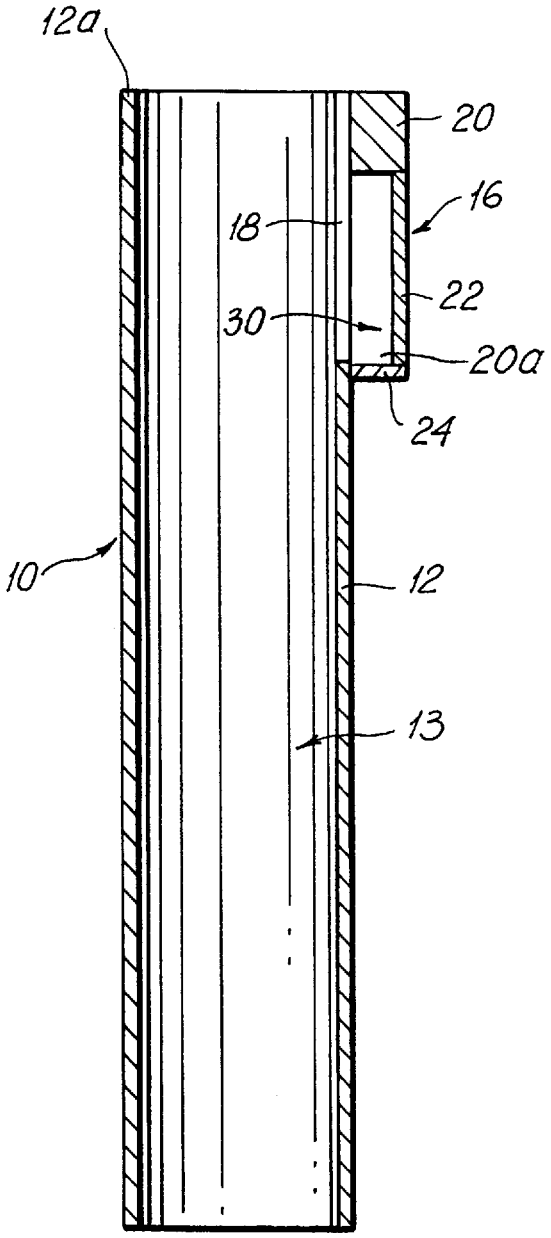
FIG. 3 is an axial sectional view of the socket of FIG. 1.
Figure 4:
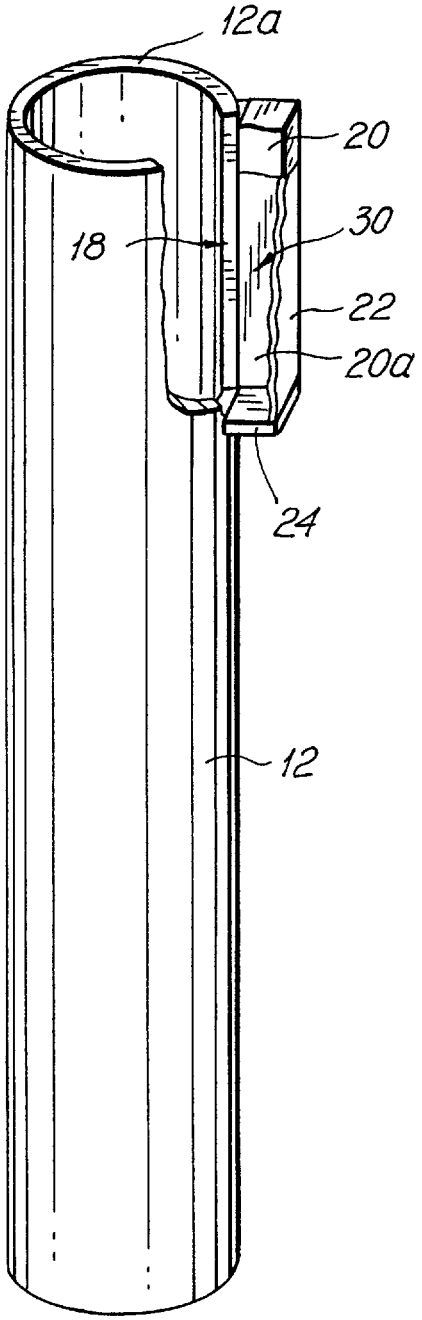
FIG. 4 corresponds to FIG. 1, but with a cut-away showing internal detail of the socket of the first embodiment.

The arrangement of sub-assembly 16 is such that, as seen most clearly in FIGS. 3 and 4, slot 18 defines an opening, between member 20 and cover 24, by which bore 13 is in communication with a chamber 30 defined within member 22.

Figure 14:
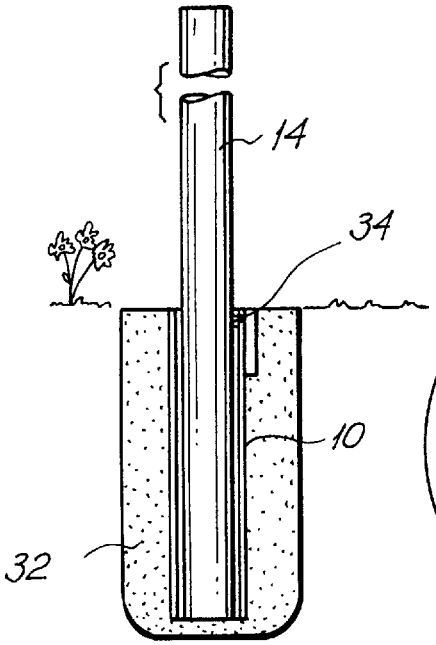
FIG. 14 shows a below-ground arrangement for a post supported with a socket according to the invention.
Figure 15:
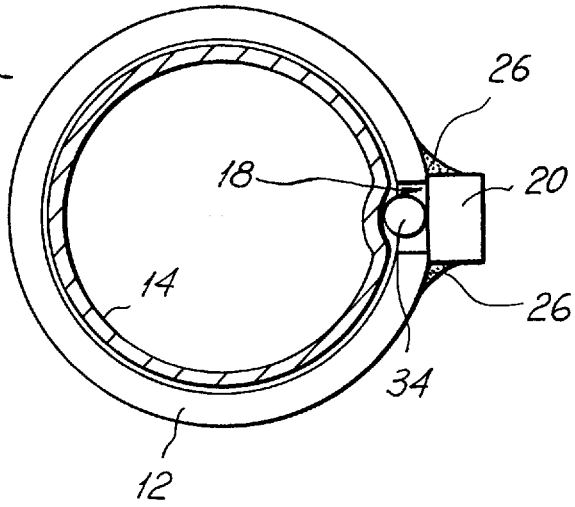
FIG. 15 shows a ground level, horizontal sectional view through the socket and post of FIG. 14.

As shown in FIG. 14, socket 10 is secured in the ground, such as in a concrete footing 32, with upper end 12*a* of body 12 substantially flush with the ground surface. The lower end of a post 14 then is inserted into socket 10 and is able to be releasably, but securely retained therein. Retention of post 14 in socket 10 is by means of a wedge 34, such as shown in FIGS. 9*a*, 9*b* and 9*c*. Socket 10 preferably is such that post 14 is receivable in bore 13 in a neat sliding fit.

The wedge 34 of FIG. 9*a* has a cylindrical body 34*a* and at its leading end, a conically tapered tip 34*b*. The wedge 34 of FIG. 9*b* is similar to that of FIG. 9*a*, but more bullet-like. The wedge 34 of FIG. 9*c* has a rectangular section body 34*a* which, at its leading end 34*b*, tapers at two opposite sides to a chisel-like tip. In each case, the lateral dimensions of wedge 34 are such that it is not more than a firm fit between the circumferentially opposed sides of slot 18. However, the dimensions are such that wedge 34 is able to be inserted into slot 18, between post 14 and block member 20 only by being hammered into slot 18, as depicted in FIG. 8. Thus, to secure post 14 in socket 10, the leading end 34*b* of wedge 34 is introduced into slot 18 and wedge 34 then is forced, such as by hammer H, fully into slot 18, between member 20 and post 14, so that the trailing end of body 34*a* is substantially flush with end 12*a* of body 12.

The section of member 20 is such that it resists deformation or displacement as wedge 34 is fully inserted, while wedge 34 is of a suitable material, such as steel or other suitable metal, so as to resist deformation. The arrangement preferably is such that any deformation is in post 14, such as depicted at 14*a* in FIG. 6.

Figures 10, 11, 12:
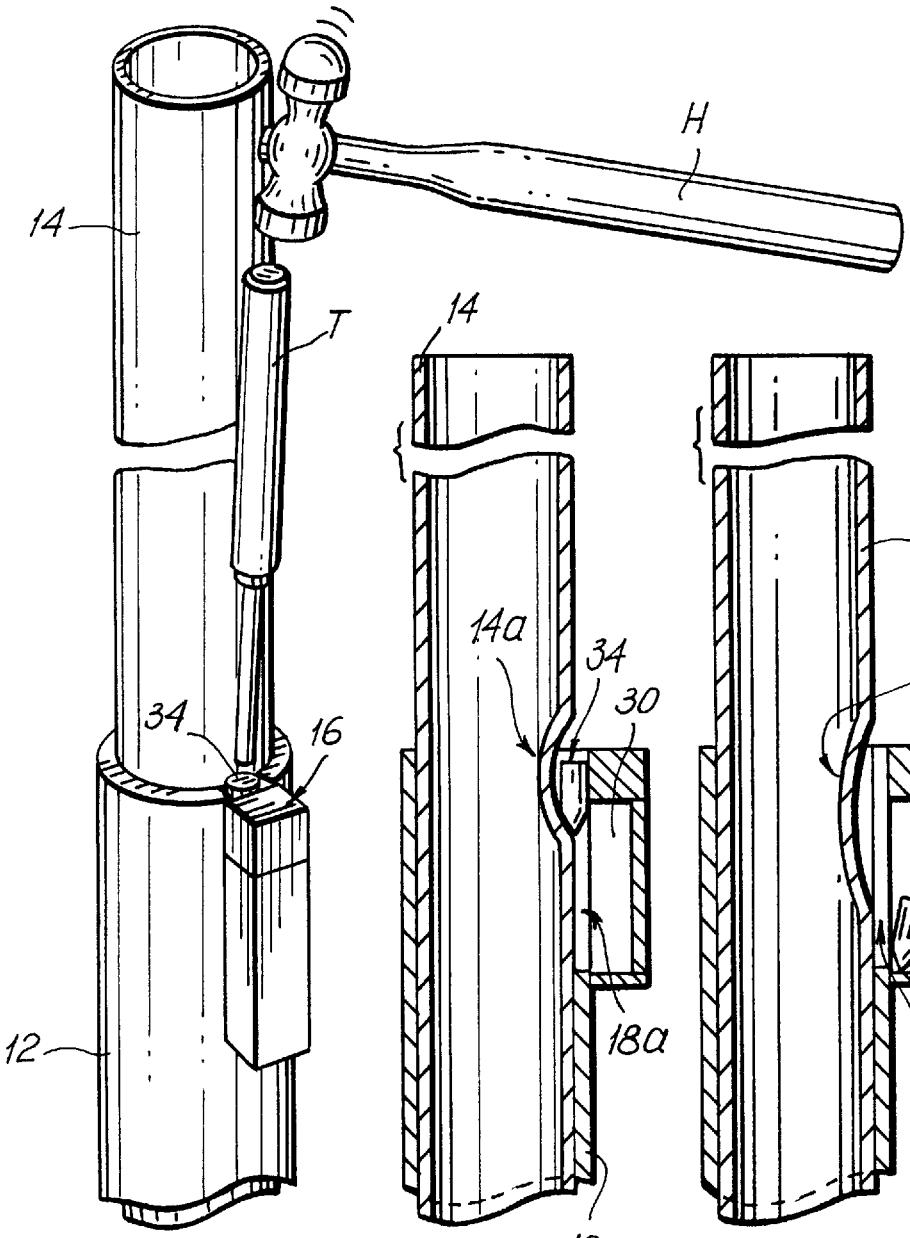
FIGS. 10 to 12 show stages in procedure for enabling removal of the post from the socket of FIG. 1.

If it is required to remove post 14, this is possible with the procedure shown in FIGS. 10 to 12. A suitable tool T is applied to the exposed end of wedge 34 and by blows imparted such as by hammer H, wedge 34 is forced below member 20. Until wedge 34 clears member 20, the deformation 14*a* of post 14 can be extended longitudinally, as shown in FIGS. 11 and 12. Finally, when wedge 34 passes member 20, it is able to be displaced laterally outwardly so as to lodge in chamber 30. Post 14 then is able to be removed.

If it subsequently is required to secure the same post 14 again in the same or another socket 10, this is possible, using the same or a further wedge 34. However, to ensure firm retention of post 14, it needs to be rotated slightly relative to the initial orientation, so that its deformation 14*a* is not at slot 18.

Where socket 10 is secured in a concrete footing 32, member 22 and cover 24 are desirable to prevent obstruction of slot 18 below member 20 by concrete mix prior to its setting. However, a less elaborate arrangement can be used, such as a plastic or cardboard cover which results in the footing 32 defining a cavity corresponding to chamber 30. Also, if socket 34 is of a form able to be driven into ground soil, a chamber 30 or corresponding cavity is not required, since a wedge 34, to be driven below member 20 to enable removal of post 14, can be displaced from slot 18 into the surrounding soil.

Slot 18 may have substantially parallel opposed sides 18' (see FIG. 5). However, in an alternative arrangement, the opposed sides may be mutually inclined (as shown by lines 18" in FIG. 5), such that the width of slot 18 increases to the outer surface of body 12 and provides a camming action which displaces a wedge 34 outwardly when it is driven below member 20. Additionally, or alternatively, slot 18 may decrease in width in a direction away from end 12*a* so as to facilitate such displacement.

Figure 13:
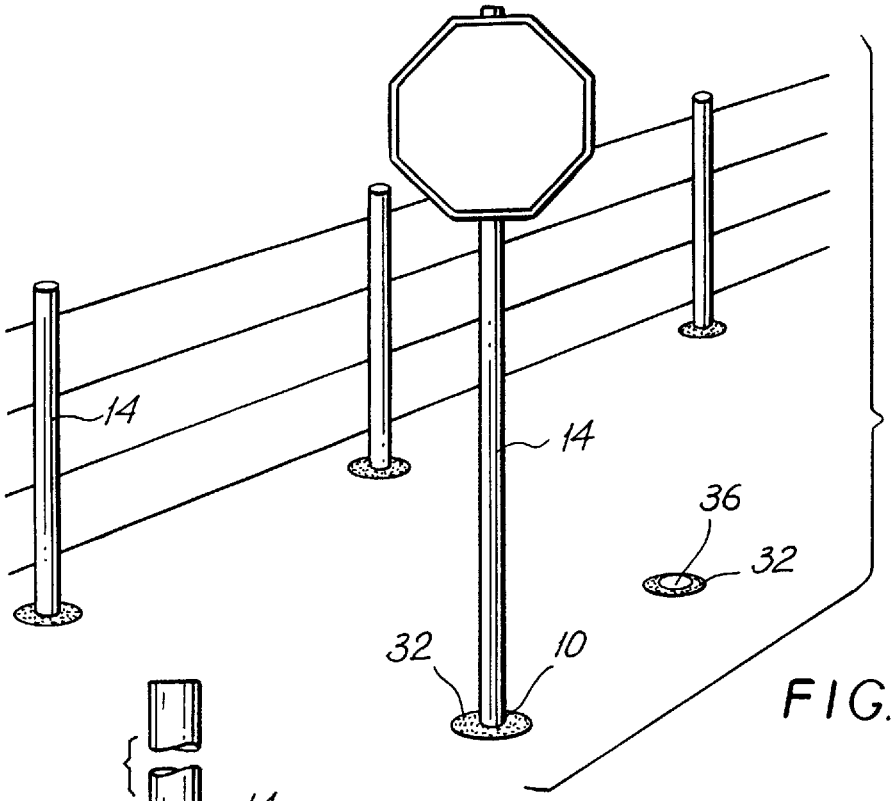
FIG. 13 shows some forms of posts for which the socket of the invention is suitable.

As depicted in FIG. 13, the socket of the invention is suitable for use with a variety of forms of post 14. Thus, it can be used for example for fencing posts and posts for road side signs. As shown in FIG. 14, the socket can be installed flush with a surrounding surface, without the need for a projecting portion to facilitate securement of a post therein. Also, as shown schematically in FIG. 13, an installed socket can readily be protected by a suitable cap 36 until it is required to receive a post therein.

Figure 16:
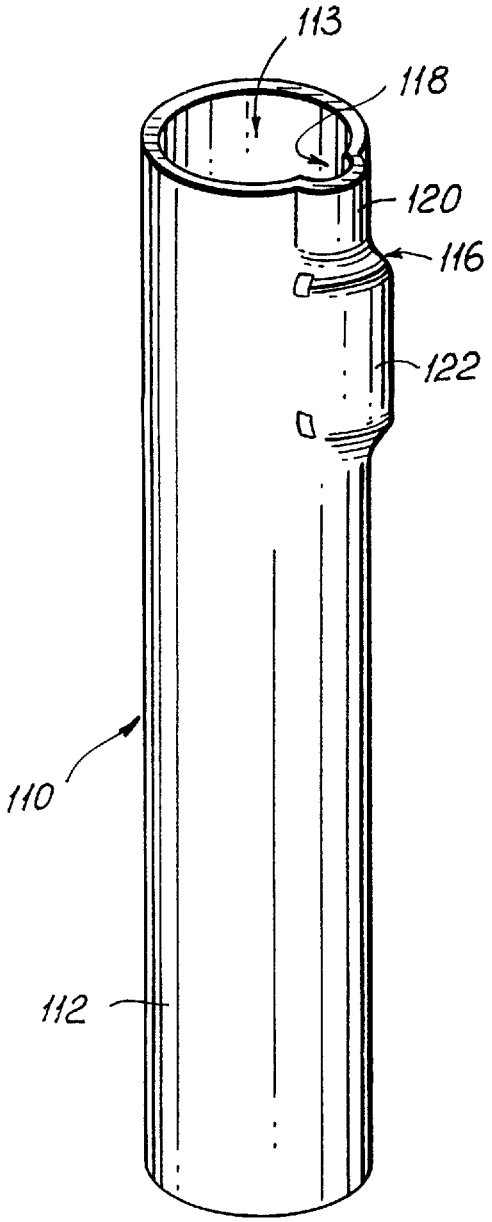
FIGS. 16 to 19 show respective further embodiments of the invention.

An alternative embodiment is shown in FIG. 16, using the same reference numerals as in FIGS. 1 to 15 plus 100. The socket 110 of FIG. 16 is of integral form, produced by hot or cold forming of a metal body 112, or by casting from a suitable metal or moulding from a suitable plastics material. In this instance, sub-assembly 116 is formed integrally with body 112. Thus, body 112 is laterally enlarged to define an internal groove 118, corresponding to slot 18 and extending outwardly from bore 113. The enlargement is greater at a lower extent of groove 118, to define an upper enlargement portion 120 corresponding to member 20, and a lower enlargement portion 122 corresponding to member 22 and cover 24. Thus, within portion 122, groove 118 is enlarged to define a chamber (not shown) which corresponds to chamber 30.

Figure 17:
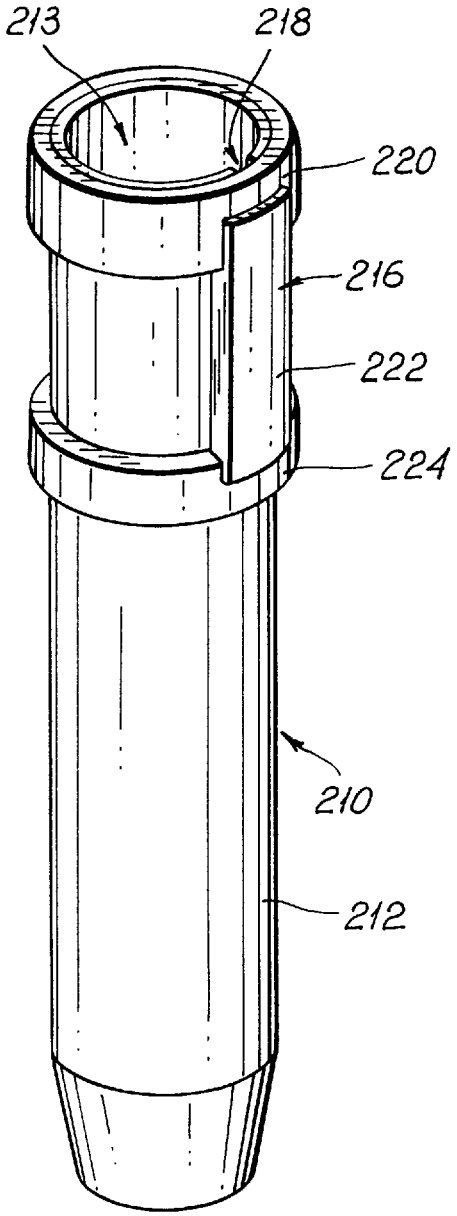

A further embodiment is shown in FIG. 17, using the same reference numerals as FIGS. 1 to 15, plus 200. Socket 210 can be formed of metal components which are welded in assembly, or plastics components which are bonded in assembly. In this instance, member 220 and cover 224 of sub-assembly 216 each comprises a respective ring secured around the outer surface of body 212 and bore 213 defined by bore 212. Member 222 is of C-section and secured over slot 218, between the rings providing members 220 and 224. Again, slot 218 opens to a chamber, corresponding to chamber 30, which while not shown is within member 222. Also, the lower end of body 212 is tapered, to facilitate it being driven into the ground, if required.

Figure 18:
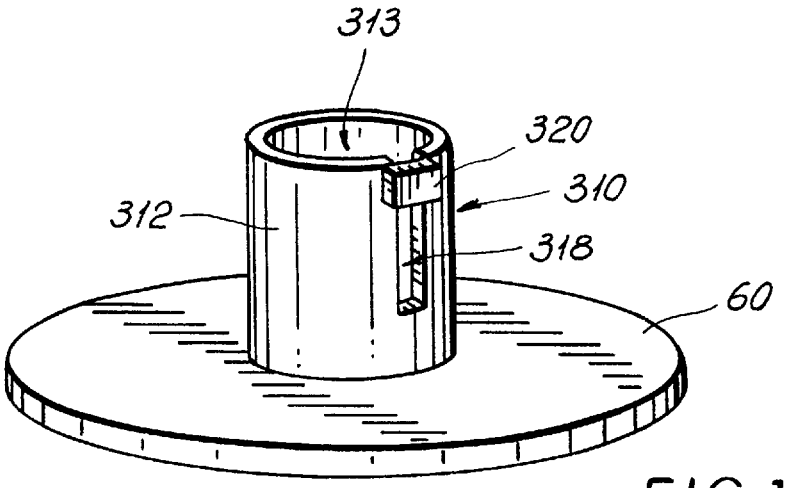
Figure 19:
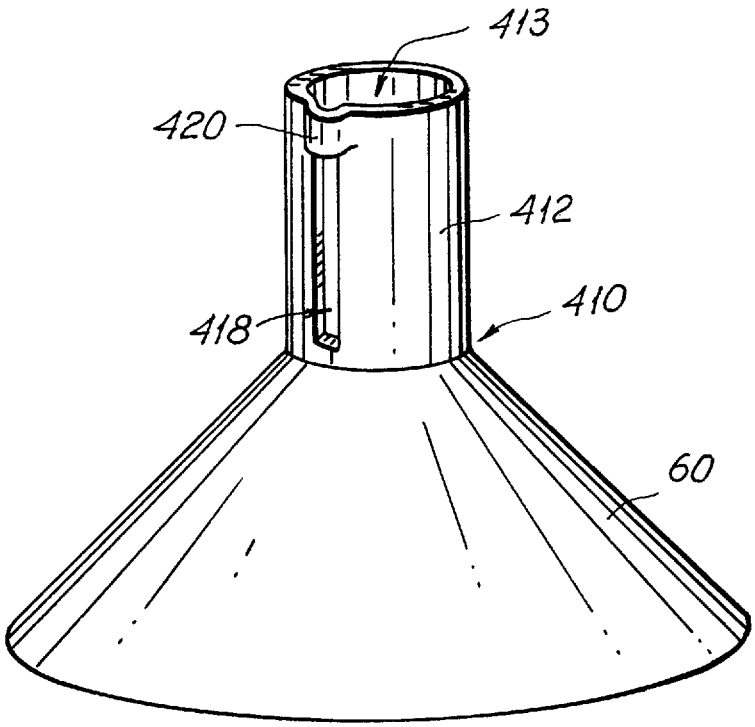

FIGS. 18 and 19 show further respective embodiments, in which parts corresponding to those of socket 10 of FIGS. 1 to 15 have the same reference numerals plus 300 in FIG. 18 and plus 400 in FIG. 19. Each of sockets 310 and 410 can be located in a ground hole, and then covered exteriorly by compacted soil. In each case, the body 312, 412 (defining respective bore 313, 413) is mounted on a respective base 60, the base 60 in FIG. 18 being a flat disc with base 60 in FIG. 19 having a frusto-conical form. As will be appreciated, each base serves as a ground engaging anchor portion. However, each base 60 can be used simply to enable socket 310, 410 to stand on a horizontal support surface.

In each of sockets 310, 410, the respective slot 318, 418 is left uncovered, except at the top where a respective member 320, 420 is provided. Member 320 is a block secured to body 312 and serves the same purpose as block member 20 of FIGS. 1 to 15. The same applies to member 420, except that this is formed by an integral part of body 412. In each case, driving a wedge below the member 320, 420 will result in the wedge passing through the respective slot 318, 418, and release of a post for removal.

Figure 20:
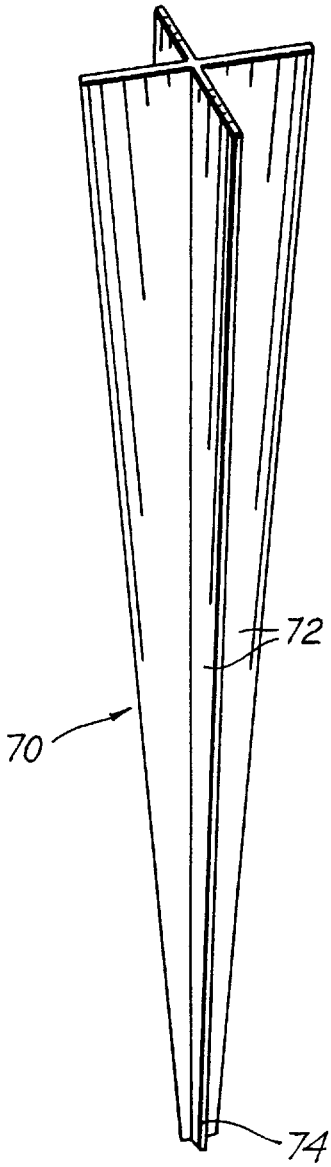
FIGS. 20 to 22 show respective forms of ground piercing devices on which the socket of the invention can be provided.
Figure 21:
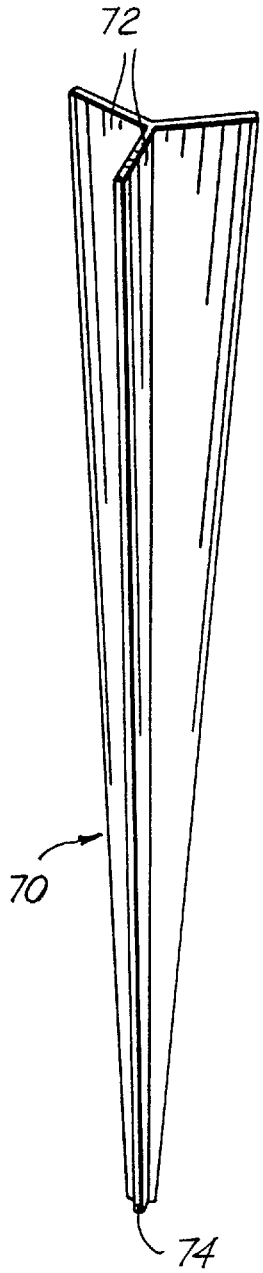
Figure 22:
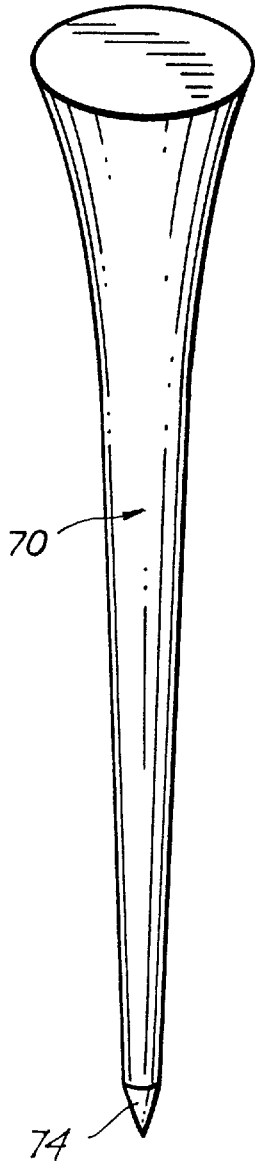

FIGS. 20 to 22 illustrate respective components 70 on which a socket, such as socket 10 of FIGS. 1 to 15, can be mounted where it is required to install the socket by driving it into the ground rather than by encasing it in a concrete footing. Each component 70 of FIGS. 20 and 21 is of spear-head form. That of FIG. 20 has a cruciform section, with four arms 72 and tapering to a leading end 74. That of FIG. 21 has a tri-star section, with three arms 72. The component 70 of FIG. 22 is somewhat like a golf-tee in overall form. In each case, a socket is intended to be secured to the larger trailing end of the component, such as by welding with the component facilitating driving the socket into the ground.

Figure 23:
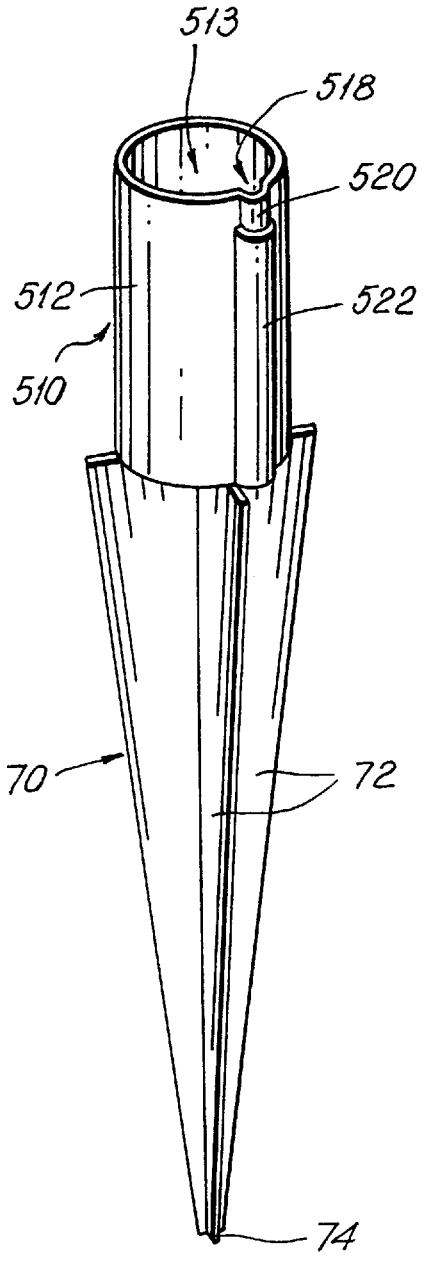
FIGS. 23 and 24 are perspective views of further respective embodiments of the invention.
Figure 24:
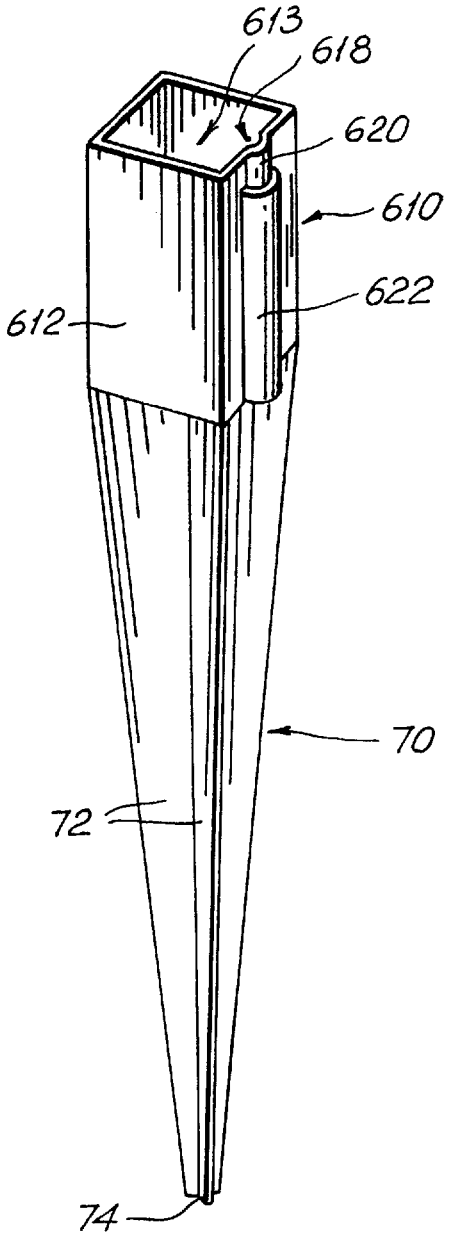

FIGS. 23 and 24 show sockets 510, 610 each of which embodies a component 70 as in FIG. 20. Parts of the sockets corresponding to those of FIGS. 1 to 15 have the same reference numeral plus 500 in FIG. 23, and plus 600 in FIG. 24. Thus, socket 510 defines bore 513 and has portions 520 and 522 which define slot 518; while socket 610 defines bore 613 and has portions 620 and 622 which define slot 618.

The form and functioning of sockets 510 and 610 readily will be understood from preceding description herein. In each case, the body 512, 612 is welded to arms 72 of component 70. However, a base plate (not shown) can be secured around the lower edge of body 512, 612 by welding, with the plate then welded to arms 72. Also, while preceding embodiments have utilized a body of circular section, socket 610 illustrates a suitable alternative in which body 612 is of square section.

FIGS. 25 and 26 show a further socket 710 adapted for use in a different context of mounting one post 714 on another post 714'. In this instance, body 712 is of penannular form, defining bore 713 and a slot 718 from end to end. At each end, a respective wedge engaging member 720, 720' is provided, each enabling insertion of a respective wedge for retaining the respective post 714, 714'.

A still further form of socket 810 is shown in FIG. 27. In this, body 812 defines slot 818 and is provided around its lower end with three laterally projecting tabs 80 to each of which a respective leg 82 of a tripod arrangement is secured. Thus, socket 810 enables post 814 to be mounted, as required, at a suitable level and in a transportable arrangement using a wedge (not shown) inserted in slot 818 behind block 820.

Figure 28:
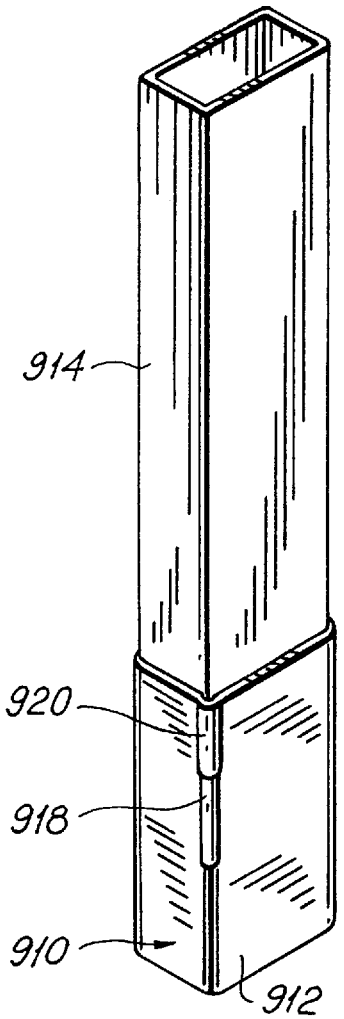
Figure 29:
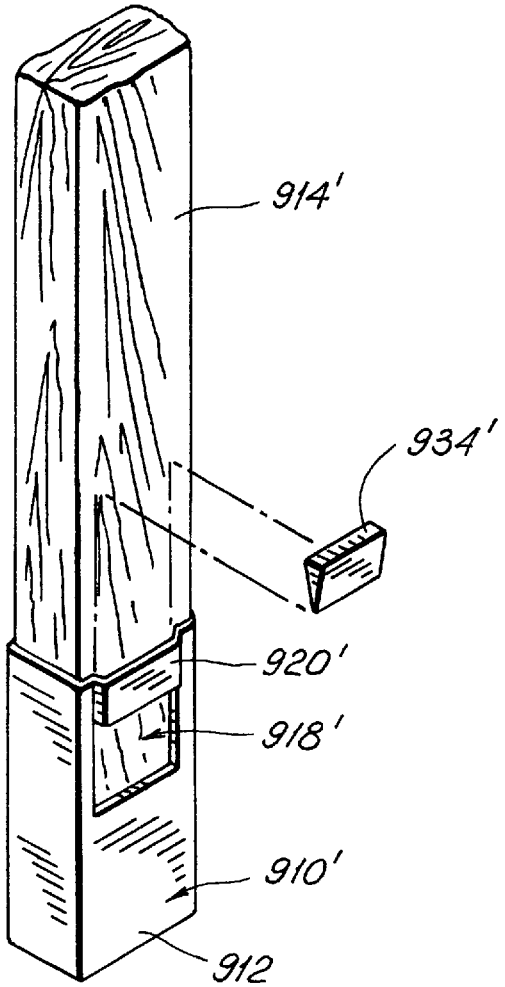

Variants 910 and 910' on a further embodiment of a socket according to the invention are shown in FIGS. 28 and 29, each of rectangular section. In socket 910 of FIG. 28, slot 918 and its co-operating member 920 are provided at a corner of body 912. Again, a wedge of suitable form (not shown) is insertable into slot 918, to secure post 914 in position, with the wedge being able to be driven below member 920, to exit from slot 918, if post 914 is to be removed.

In socket 910' of FIG. 29, the arrangement is somewhat similar, except that slot 918' and member 920' are at a side face of body 912', rather than at a corner. Also, slot 918' is relatively wide, but still bridged by member 920', and a corresponding by wide wedge 934' is used.

The socket 910 of FIG. 28 is well suited for use with a hollow box section post 914. A wedge against the centre of the span of a flat wall of the post may tend to distort the wall inwards thus weakening the wedge grip, whereas good gripping and retention of post 914 is obtained at a corner as shown. However, the socket 910' of FIG. 29 is preferable for use on wooden posts or the like. Because wooden posts are sometimes to some degree soft, a rounded or narrow wedge may tend to crush into the wood rather than hold the required wedging pressure. The wide slot 918' and wedge 934' accommodates such softness but still provides good retention of post 914'.

Each embodiment of the invention provides good securement for a post, with the wedge driven in full so as to be flush with the top end of the socket body. While release of the post is possible, this fact is not readily apparent and, in any event, necessitates use of suitable implements. Also, in addition to release of a post not being evident from external appearances, this is not achieved by reversal of the securement procedure, as is the case with prior art arrangements. Withdrawal of a properly inserted wedge is very difficult to achieve, while the normal expectation would be that driving the wedge deeper will only further secure the post.

Finally, it is to be understood that various alterations, modifications and/or additions may be introduced into the constructions and arrangements of parts previously described without departing from the spirit or ambit of the invention.

I claim:

1. A post support socket in which an end portion of a post is supportable for securement by a wedge member; wherein the post support socket has an elongate body in which a longitudinal bore extends from an inlet end of the body; the body includes a peripheral wall having an internal surface defining the bore; the peripheral wall defines a slot which extends longitudinally from the inlet end of the body and which along the length of the slot opens to the bore; and the peripheral wall has a laterally offset portion which bridges the slot over part of the length of the slot from the inlet end of the body with the slot extending longitudinally beyond the offset portion; the offset portion forms part of a sub-assembly which defines a chamber exteriorly of the peripheral wall whereby the chamber and the bore are in communication along said slot; whereby, in use of the post support socket, a post having an end portion received in the bore can be secured by forcefully driving a wedge member longitudinally into the slot from the inlet end, between the offset portion and the post end portion, whereby the post then can be withdrawn from the post support socket after forcefully driving the wedge member longitudinally beyond the offset portion, for discharge of the wedge member laterally outwardly away from the bore, and whereby the wedge when driven beyond the offset portion is receivable in the chamber.

2. A post support socket, in which an end portion of a post is supportable for securement by a wedge member; wherein the post support socket has an elongate body in which a longitudinal bore extends from an inlet end of the body; the body includes a peripheral wall having an internal surface defining the bore; the peripheral wall defines a slot which extends longitudinally from the inlet end of the body and which along the length of the slot opens to the bore; and the peripheral wall has a laterally offset portion which bridges the slot over part of the length of the slot from the inlet end of the body with the slot extending longitudinally beyond the offset portion; whereby, in use of the post support socket, a post having an end portion received in the bore can be secured by forcefully driving a wedge member longitudinally into the slot from the inlet end, between and in contact with each of the offset portion and the post end portion, and whereby the post then can be withdrawn from the post support socket after forcefully driving the wedge member longitudinally away from the inlet end, beyond the offset portion, for discharge of the wedge member laterally outwardly away from the bore.

3. A port support socket according to claim 2 including an elongate ground engaging portion, wherein an end of said inlet end is secured to one end of the ground engaging portion and wherein said ground engaging portion tapers so as to be of decreasing cross-section towards the other end of the elongate ground engaging portion to enable said socket to be driven into the ground.

4. A post support socket according to claim 3, wherein said ground engaging portion has a star-shaped cross-section.

5. A post support socket according to claim 3, wherein said ground engaging portion has a circular cross-section.

6. A post support socket according to claim 2 wherein said body, at an end thereof remote from said inlet end, surrounds and is made integral with a base member whereby the socket is adapted to be free-standing.

7. A post support socket, in which an end portion of a post supportable for securement by a wedge member; wherein the post support socket has an elongate body in which a longitudinal bore extends from an inlet end of the body; the body includes a peripheral wall having an internal surface which defines the bore and which, over at least part of the length of the body from the inlet end, has a laterally offset portion which defines a longitudinal slot which opens to the bore; wherein said slot has a first longitudinal section which extends from the inlet end and a second longitudinal portion which extends beyond said first section, with said first section of the slot having a smaller transverse cross-section than said second portion of the slot; whereby, in use of the post support socket, a post having an end portion received in the bore can be secured by forcefully driving a wedge member longitudinally into the first section of the slot from the inlet end, between and in contact with each of the post end portion and part of the offset portion defining said first section of the slot, and whereby the post then can be withdrawn from the post support socket after forcefully driving the wedge member longitudinally away from the inlet end, beyond the first section of the slot, for discharge of the wedge member laterally outwardly away from the bore, into said second section of the slot.

8. A post support socket according to claim 7, further including an elongate ground engaging portion, wherein an end of said inlet end is secured to one end of the ground engaging portion and wherein said ground engaging portion tapers so as to be of decreasing cross-section towards the other end of the elongate ground engaging portion to enable said socket to be driven into the ground.

9. A post support socket according to claim 8, wherein said ground engaging portion has a star-shaped cross-section.

10. A post support socket according to claim 8, wherein said ground engaging portion has a circular cross-section.

11. A post support socket according to claim 7, wherein said body, at an end thereof remote from said inlet end, surrounds and is made integral with a base member whereby the socket is adapted to be free-standing.

* * * * *